United States Patent [19]

Szemeredi et al.

[11] Patent Number: 4,502,165

[45] Date of Patent: Mar. 5, 1985

[54] WASHER AND NUT COMBINATION FOR LOCKING PLUMBING FIXTURES TO A SINK DECK OR THE LIKE

[75] Inventors: Robert S. Szemeredi, Tujunga; Matthew G. Tarnay, Pasadena; Kenneth Lee, Los Angeles, all of Calif.

[73] Assignee: Price Pfister, Inc., Pacoima, Calif.

[21] Appl. No.: 493,648

[22] Filed: May 11, 1983

[51] Int. Cl.[3] ..... E03C 1/04

[52] U.S. Cl. ..... 4/192; 137/359; 137/801; 411/539; 411/533

[58] Field of Search ..... 411/368, 539, 531, 533, 411/378, 427, 402, 409, 435, 432, 540, 541, 116, 411/117, 119, 120; 285/161; 137/359, 360, 801; 4/192

[56] References Cited

U.S. PATENT DOCUMENTS

| | | | |
|---|---|---|---|
| 1,201,022 | 10/1916 | Conniff | 411/432 |
| 1,281,122 | 10/1918 | Bechberger | 411/116 |
| 1,452,492 | 4/1923 | Carpenter | 411/539 X |
| 2,096,602 | 10/1937 | Weingarten | 4/192 |
| 2,358,832 | 9/1944 | Schonitzer | 411/432 |
| 2,374,309 | 4/1945 | Roxs | 411/432 |
| 3,368,443 | 2/1968 | Faul | 411/427 |

FOREIGN PATENT DOCUMENTS

| | | | |
|---|---|---|---|
| 2314168 | 10/1973 | Fed. Rep. of Germany | 411/427 |
| 2843770 | 4/1980 | Fed. Rep. of Germany | 411/427 |
| 1309208 | 10/1962 | France | 411/402 |
| 1427828 | 1/1966 | France | 411/402 |
| 86067 | 4/1920 | Switzerland | 411/122 |
| 581061 | 9/1946 | United Kingdom | 411/435 |
| 718958 | 11/1954 | United Kingdom | 411/539 |

*Primary Examiner*—Gary L. Smith
*Assistant Examiner*—Adrian H. Whitcomb, Jr.
*Attorney, Agent, or Firm*—Flam & Flam

[57] ABSTRACT

A nut and washer unit for attachment of a plumbing faucet or fixture permits rapid and easy mounting at a supporting structure. The nut is placed on the shank before the faucet or fixture is dropped through the mounting hole. A C-shaped washer is positioned from below, between the nut and the mounting structure. An axially separable coupling between the nut and washer achieves initial placement of both parts at the mounting structure by simple hand rotation of the nut. Final clamping is achieved by engagement of wings formed on the washer, rotation of the washer causing corresponding rotation of the nut and, hence, advancement of both parts into clamping position.

8 Claims, 4 Drawing Figures

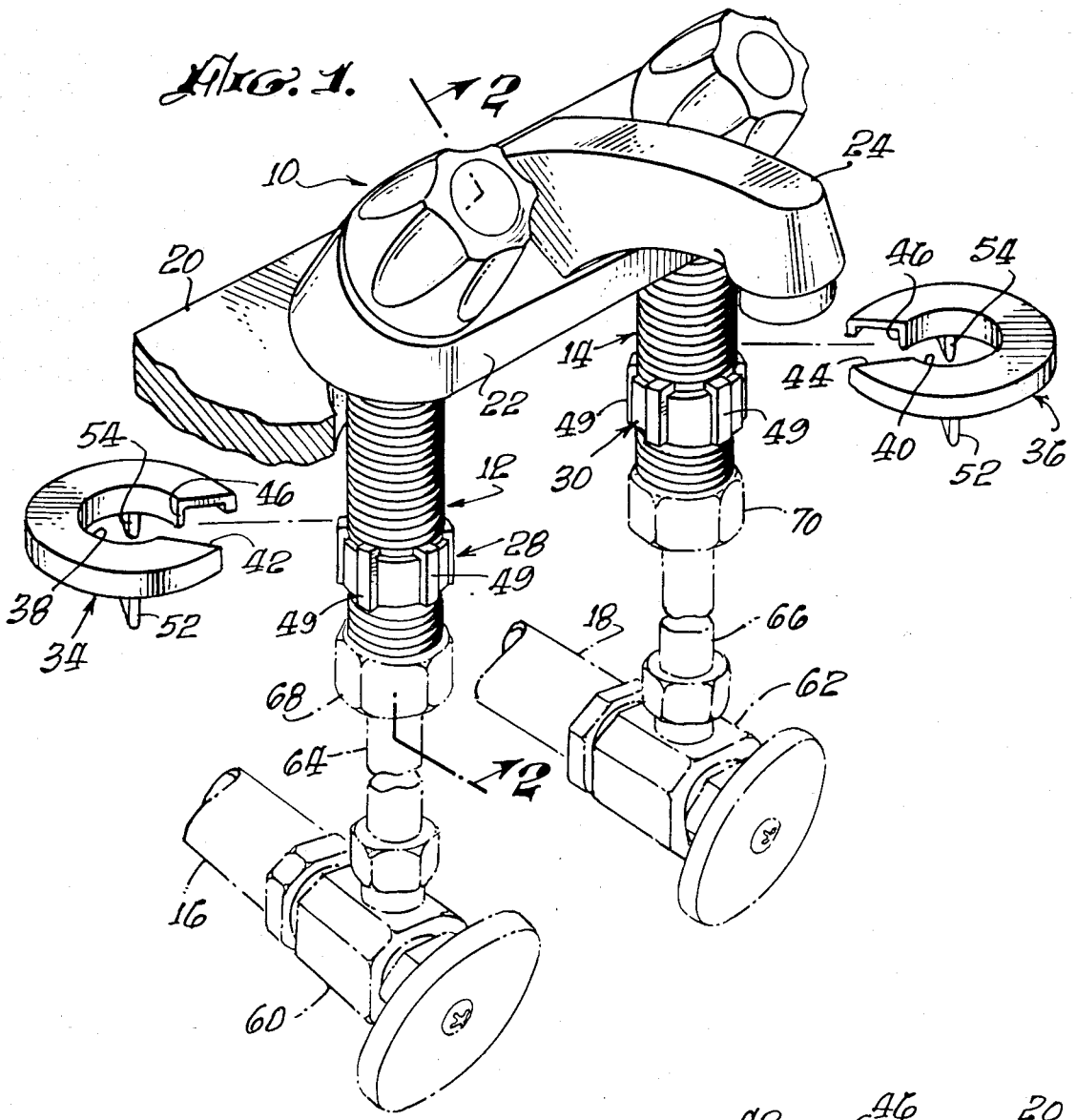
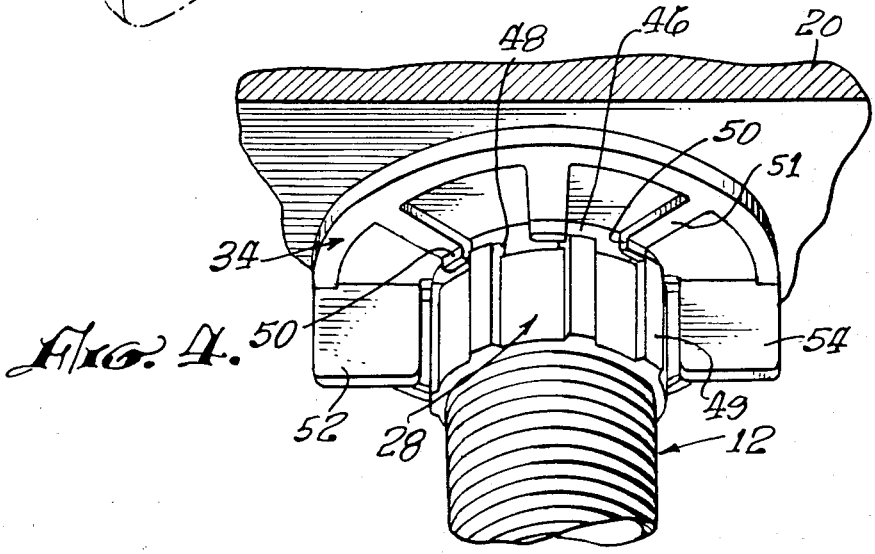
FIG. 4.

WASHER AND NUT COMBINATION FOR LOCKING PLUMBING FIXTURES TO A SINK DECK OR THE LIKE

FIELD OF INVENTION

This invention relates to plumbing fixtures, and more particularly to a method of attaching faucets and fixtures to a lavatory deck or other mounting structure.

BACKGROUND OF THE INVENTION

A plumbing fixture according to long established prior art methods, is installed on a lavatory deck or other mounting structure by dropping the threaded shanks of the fixture body through holes in the mounting structure. A washer is then placed on the shanks from below, the nut is started and then tightened as by the aid of a suitable tool. This is quite cumbersome since, in most situations, the space beneath the mounting structure is quite confined. Lighting from below, if provided, is often obscured by the installer. The installation requires more than two hands; two hands are required to start the nut below, and one hand is required to hold the fixture down against the upward force exerted. Once the fixture itself is clamped in place, flexible or bendable risers must be manipulated between the shutoff or angle stop valves at one end, and the faucet body shanks at the other end. This, too, is cumbersome due to the confined space.

A combined or unitary nut and washer structure is known. This eliminates the annoyance of dealing with the washer separately. Yet, the manipulations are still tedious.

OBJECTS OF THE INVENTION

The primary object of this invention is to provide an attachment device for plumbing fixtures and faucets that operates in a very facile manner. Another object of this invention is to provide a device of this character that can be used with any fixture or faucet having the usual threaded shank or shanks. Still another object of the present invention is to provide a device of this character that is made of two simple moldable parts and that requires no auxiliary tools for operation.

SUMMARY OF INVENTION

In order to accomplish the foregoing objects, we provide a nut part normally carried by the shank of the faucet or fixture so that it freely passes through the mounting hole along with the shank. When the faucet or fixture is in place on the mounting surface, a C-shaped washer part companion to the nut part is moved laterally into position on the shank. The washer is located between the nut and the mounting structure. The nut and the washer parts have axially separable interfitting elements coupling them for conjoint angular movement about the shank. Initially, the nut is worked by hand to rotate the coupled parts until a light pressure contact is made between the washer and the under surface of the mounting structure. The washer has wings that are now digitally engaged to complete the attachment. Thus rotation of the washer by manipulation of its wings causes corresponding angular movement of the nut and consequently, axial movement of both parts until the fixture or faucet is firmly clamped. Preferably the central opening of the washer extends slightly more than 180° to provide a restriction so that, once the washer is in place, lateral separation from the shank is yieldingly resisted.

BRIEF DESCRIPTION OF DRAWINGS

A detailed description of the invention will be made with reference to the accompanying drawings wherein like numerals designate corresponding parts in the several figures. These drawings are to scale.

FIG. 1 is a pictorial view of a lavatory fixture mounting deck and angle stop valve, illustrating the novel nut and washer unit in the initial phase of installation. The flexible or bendable riser and its clamp nut are shown in phantom lines.

FIG. 4 is a perspective view showing the final phase of installation.

DETAILED DESCRIPTION OF PREFERRED EMBODIMENT

Figure 2:
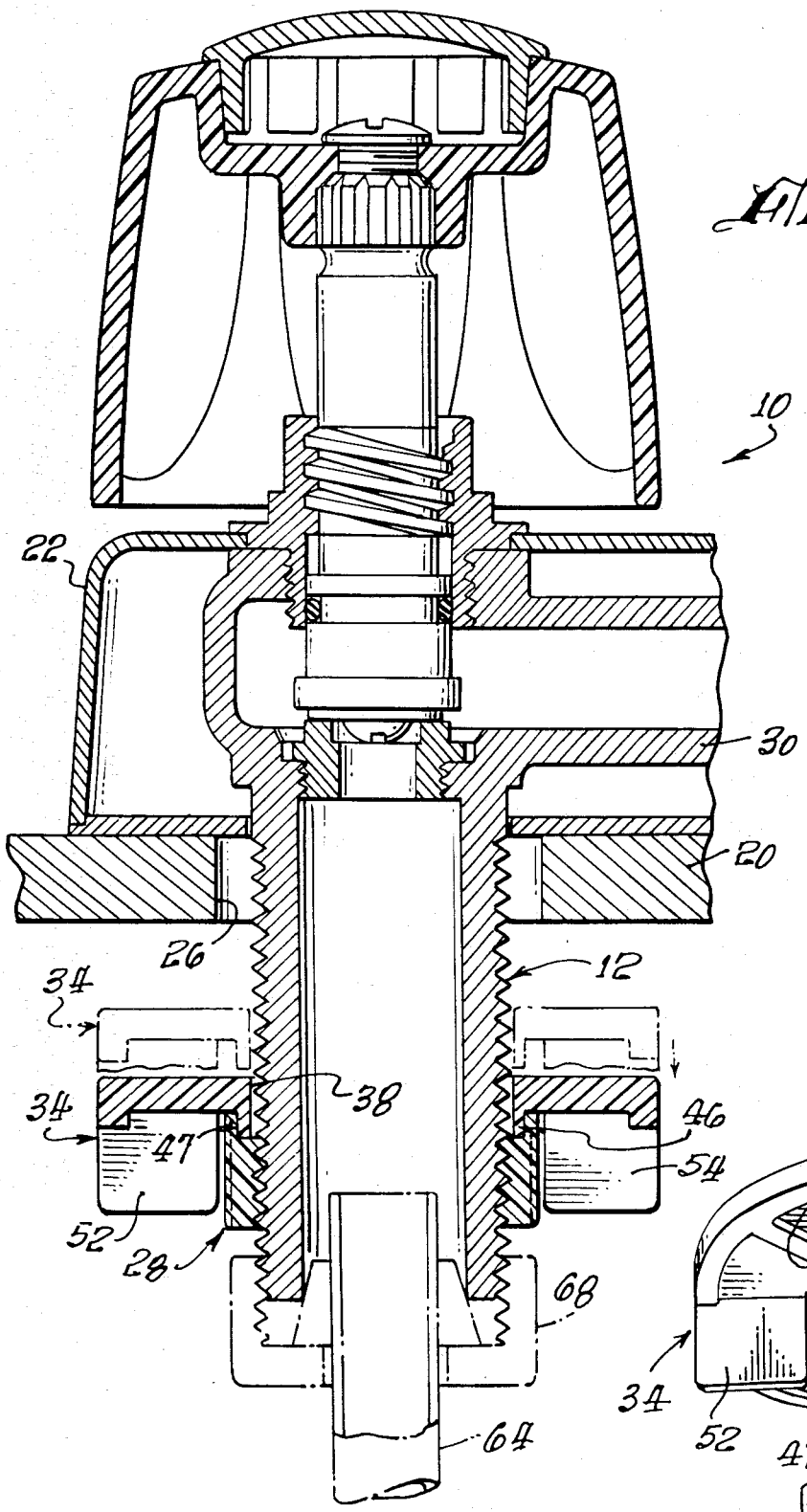
FIG. 2 is an enlarged longitudinal sectional view through one side of the fixture and taken along a plane corresponding to line 2—2 of FIG. 1.

The following detailed description is of the best presently contemplated mode of carrying out the invention. This description is not to be taken in a limiting sense, but is made merely for purposes of illustrating the general principles of the invention, since the scope of the invention is best defined by the appended claims.

In FIG. 1, there is illustrated a typical lavatory fixture 10. The fixture includes a casting of metal or plastic having a pair of threaded shanks 12 and 14 designed to connect with hot and cold water supply lines 16 and 18 located beneath a cabinet deck 20. The main part of the casting is concealed by decorative cover and spout parts 22 and 24.

The fixture 10 is dropped into place through holes 26 in the deck 20. Already in place, near the distal ends of the casting shanks 12 and 14, are nuts 28 and 30. Each nut comprises one of two companion parts of the new attachment unit. The nuts 28 and 30 are, of course, larger in diameter than the shanks 12 and 14, but small enough freely to pass through the mounting holes 26 with the shanks 12 and 14.

After the fixture 10 is dropped through the mounting holes, two washers 34 and 36 are moved into place on the shanks 12 and 14 from beneath the deck. The washers are placed above the nuts 28 and 30. The washers 34 and 36 are generally of C-shape, having central circular openings 38 and 40 intercepted by lateral access slots 42 and 44. The slots 42 and 44 allow lateral placement of the washers on the shanks. The washer openings 38 and 40 extend slightly more than 180° to provide a small negative clearance with respect to the shanks so that, once each washer is installed, separation from its shank is yieldingly resisted. For this purpose, the washers 34 and 36 are molded of a thermoplastic material having suitable characteristics of toughness, resilience and flexibility. The lateral access slots 42 and 44 diverge slightly to provide wide mouths for easy reception of the shanks.

In the phantom line position of FIG. 2, the washer 34 is shown snapped over the shank 12. It can then be dropped into place on top of the nut 28. Once the washer 34 is dropped into place, it cannot be moved laterally. For this purpose, the washer has a partial collar 46 located centrally on its underside. The collar fits inside a short axially extending rim 47 at the upper end of the nut 28. The collar 46, like the opening that it surrounds, is interrupted by the access slot 42.

When the nut 28 and washer 34 are so registered, a rotary coupling between the parts is established. For this purpose, the nut has wrench-like teeth 48 that castellate the nut rim 47. The teeth 48 are formed as projecting upper ends of a series of equiangularly spaced peripheral ribs 49 of the nut 28. The teeth or castellations 48 interdigitate teeth or projections 50 formed about the collar 46. The angular spacing between the projections 50 is greater than the angular width of the castellations 48; hence, there is some initial lost motion between the parts as the rotary connection is operated.

In the full line position of FIG. 2, the nut 28 is manually rotated. Both parts then advance until light contact is achieved between the washer and the undersurface of the deck 20. No tedious initial threading functions are required.

Figure 3:
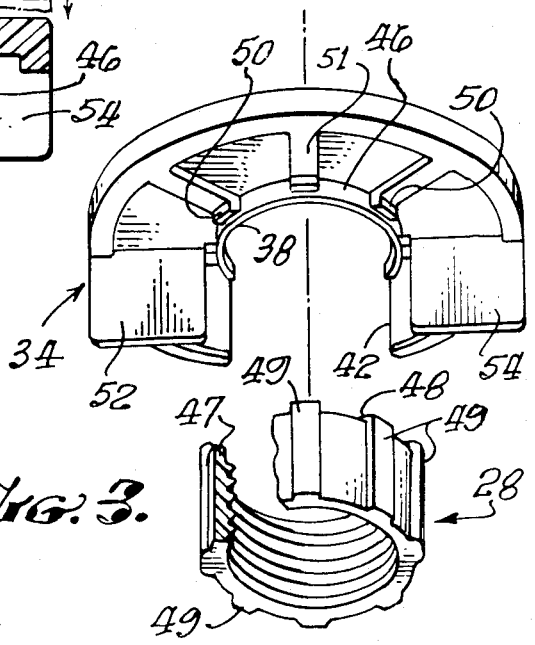
FIG. 3 is a pictorial view of the nut and washer unit from below, and showing the axially separable coupling therebetween.

In the position of FIG. 4 in which light contact with the undersurface of the deck is achieved, resistance to further angular movement will be encountered. In order to achieve suitable tightening, the washer has two wings 52 and 54 located diametrically on opposite sides of the restriction to the washer opening as shown in FIG. 3. The wings 52 and 54 provide pads for application of digital pressure for turning the washer. The washer now rotates the nut by virtue of the lost motion connection of the castellations 48 and the projections 50. Further angular movement of the parts about the common axis achieves firm clamping. During this final movement, any tendency of the washer 34 to move laterally is prevented by the axial registry of the collar 46 with the rim 47.

The washer 34 is strengthened by ribs 51 that radiate from the projections 50. The wings 52 and 54 serve a strengthening function at the position of two of the projections 50. By locating the wings 52 and 54 at the first and last projections about the interrupted collar, the wings conveniently serve to transmit digital pressure for lateral snap movement of the washer 34 over the shank 12.

The nut and washer unit is usable with all fixtures and faucets having threaded shanks. The unit furthermore facilitates connection between the shanks and the angle stop valves 60 and 62 (FIG. 1). For this purpose, flexible risers 64 and 66 can be attached to ends of the shanks as by slip joint nuts 68 and 70 before the fixture is installed on to the deck. It is only necessary to ensure that the slip joint nuts 68 and 70 are adequately sized to pass through the deck holes. Cumbersome manipulations beneath the deck to attach the risers 64 and 66 to the shanks are avoided.

Intending to claim all novel, useful and unobvious features shown or described, we make the following.

We claim:

1. In a plumbing installation including a plumbing fixture having an externally threaded shank and a mounting structure having a hole through which the shank extends, THE COMBINATION THEREWITH OF a nut part and a washer part forming a separable unit for securing said plumbing fixture at said mounting structure, said nut part being threadedly mounted on said shank and sized to pass through said hole while in place on said shank, said washer part having an opening intercepted by a lateral access slot for lateral placement of the washer part on the shank between the nut part and the mounting structure while the nut part is to the distal end of the shank relative to said mounting structure, said nut and washer parts having means forming an axially separable connection therebetween so that, when connected, rotation of either the nut part or the washer part rotates both, one of said parts having outwardly extending projections to facilitate rotation said washer part being clamped against said mounting structure to secure said plumbing fixture thereto when said nut and washer parts are axially positioned in one direction along said shank to the limit allowed by said washer part.

2. The combination as set forth in claim 1 in which said washer part is made of material having characteristics of toughness, resilience and slight flexibility, said washer opening having a restriction sized nominally to slightly less than the outside diameter of the companion shank so that removal of the washer part from the shank is yieldingly resisted.

3. The combination as set forth in claim 1 or 2 in which said nut part has a castellated rim interdigitating radially extending ribs of said washer part, said washer part having a collar surrounding its opening and fitting the rim to maintain concentric registry between the parts to resist lateral movement of the washer part.

4. The combination as set forth in claims 1 or 2 in which said projections are formed as digital pad wings on said washer part.

5. The combination as set forth in claim 2 in which said projections are formed on said washer part to extend substantially at right angles to said access slot and on opposite sides thereof to provide parts digitally accessible for forcing said restricted opening past said shank.

6. A nut part and a washer part forming a unit for use with a plumbing fixture or faucet having a threaded shank designed to be inserted through a hole in a mounting structure, said washer part having an opening intercepted by a lateral access slot for lateral placement of the washer part on the shank at the inside of the mounting structure, said nut and washer parts having means forming an axially separable connection therebetween so that, when connected, rotation of either the nut or the washer rotates both, one of said parts having outwardly extending projections to facilitate rotation, said nut part having a castellated rim interdigitating radially extending ribs of said washer part, said washer part having a collar surrounding its opening and fitting the rim to maintain concentric registry between the parts to resist lateral movement of the washer part.

7. The combination of nut and washer parts as set forth in claim 6 in which said projections are formed as wings on said washer part.

8. The combination set forth in claim 3 in which said projections are formed as digital pad wings on said washer part.

* * * * *